US007128394B2

(12) United States Patent
Takenaka

(10) Patent No.: US 7,128,394 B2
(45) **Date of Patent: *Oct. 31, 2006**

(54) COLOR INKJET PRINT APPARATUS CAPABLE OF CHANGING ORDERS OF INKS SQUIRTS

(75) Inventor: Hirokazu Takenaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/290,309

(22) Filed: Nov. 29, 2005

(65) Prior Publication Data

US 2006/0071970 A1 Apr. 6, 2006

Related U.S. Application Data

(63) Continuation of application No. 10/659,198, filed on Sep. 9, 2003, now Pat. No. 6,997,542.

(30) Foreign Application Priority Data

Sep. 13, 2002 (JP) ..... 2002-269175
Jun. 13, 2003 (JP) ..... 2003-169256

(51) Int. Cl.
*B41J 2/21* (2006.01)

(52) U.S. Cl. ..... 347/43; 347/9; 347/12

(58) Field of Classification Search ..... None
See application file for complete search history.

(56) References Cited

U.S. PATENT DOCUMENTS 4,593,295 A 6/1986 Matsufuji et al. ..... 347/43
6,827,424 B1 12/2004 Teshigawara et al. ..... 347/43
7,006,251 B1 * 2/2006 Fujino ..... 358/1.9

FOREIGN PATENT DOCUMENTS

JP 11-170574 6/1999
JP 2000-318190 11/2000
JP 2001-096770 4/2001

* cited by examiner

*Primary Examiner*—Thinh Nguyen
(74) *Attorney, Agent, or Firm*—Cooper & Dunham LLP

(57) ABSTRACT

An apparatus for printing color inkjet images includes an image processing unit which processes source color data to generate output color data together with a signal indicative of an order of ink squirts in which a plurality of inks of respective colors are squirted onto a given pixel, and an inkjet print unit which is configured to squirt the plurality of inks in different orders of ink squirts, and prints color images based on the output color data by squirting the inks in the order of ink squirts indicated by the signal.

20 Claims, 9 Drawing Sheets

COLOR INKJET PRINT APPARATUS CAPABLE OF CHANGING ORDERS OF INKS SQUIRTS

CROSS-REFERENCE TO RELATED APPLICATION

This application is a Rule 1.53(b) Continuation of U.S. Ser. No. 10/659,198, filed Sep. 9, 2003 now U.S. Pat. No. 6,997,542, the entire contents of which are incorporated by reference herein.

BACKGROUND OF THE INVENTION

1. Field of the Invention

The present invention generally relates to color inkjet print apparatuses, and particularly relates to a color inkjet print apparatus which can squirt color inks in a plurality of different sequences. The present invention also relates to an image formation controlling apparatus and a color inkjet printing method.

2. Description of the Related Art

Inkjet print apparatuses that employ inkjet heads for formation of images are used in printers, facsimile apparatuses, copier machines, and the like. The inkjet head is provided with a plurality of nozzles for squirting ink droplets and actuator devices such as electromechanical transducers or electro-thermo transducers corresponding to respective nozzles. Such inkjet head is used as a print head to print high-resolution images with high quality at high speed by forcing ink droplets out of the nozzles onto a record medium (on which ink droplets are placed) in response to record signals.

Such inkjet print apparatuses include a carriage-scan-type color inkjet print apparatus. The carriage-scan-type color inkjet print apparatus has a carriage on which a print head is mounted, and the print head includes a plurality of nozzle lines arranged in the main scan direction, with each nozzle line comprised of a plurality of nozzles and extending in the sub-scan direction. These nozzle lines are assigned to respective colors for squirts of respective color inks through each nozzle, thereby printing color images on a record medium.

Such color inkjet print apparatus creates a color image by the mixing of subtractive colors that places color inks at the same place on the record medium. In order to improve print speed, printing is performed on each way the carriage goes and returns. This is referred to as a two-way print method.

When the two-way print method is carried out with a plurality of nozzles for one color being arranged in the sub-scan direction and a plurality of nozzle lines for respective colors being arranged in the main scan direction, the colors are superimposed in a certain sequence as the carriage goes one way, and are superimposed in a reversed sequence as the carriage returns. This results in the appearance of color prints being different depending on the size of nozzles. For example, the nozzle lines of a print head may be arranged in the order of Y (yellow), M (magenta), C (cyan), and K (black) in the main scan direction. On the way the carriage goes, inks are superimposed in the order of Y, M, and C. On the way the carriage returns, inks are superimposed in the order of C, M, and Y. This creates slightly different appearance of colors that are created by the mixing of subtractive colors.

Japanese Patent Application Publication No. 2001-096770 (Patent Document 1) discloses an inkjet print apparatus which has nozzle lines of respective colors arranged in a symmetric order in the scan direction, thereby achieving the same sequence of color superimposition on each way the head goes and returns.

Japanese Patent Application Publication No. 2000-318190 (Patent Document 2) teaches changing the method of color correction between the way the head goes and the way the head returns, thereby preventing the appearance of colors from varying. Here, the method of color correction converts R (red), G (green), and B (blue), which are three primary colors typically obtained as input data, into CMYK colors that are used by the inkjet print apparatus.

Japanese Patent Application Publication No. 11-170574 (Patent Document 3) actively finds merits in the fact that the appearance of colors differs, and teaches achieving high-quality print by setting the order of ink superimposition to any order.

Patent Document 1 and Patent Document 2 recognize nothing but problems in the fact that the appearance of colors varies depending on the order of ink superimposition. They only attempt to eliminate or make less conspicuous the difference of color appearances.

Patent Document 3 only teaches letting a user specify the sequence of color superimposition. Further, since no particular image processing is performed to match a selected sequence of color superimposition, it is difficult to make the most of the merits.

SUMMARY OF THE INVENTION

It is a general object of the present invention to provide a color inkjet print apparatus that substantially obviates one or more problems caused by the limitations and disadvantages of the related art.

It is another and more specific object of the present invention to provide a color inkjet print apparatus which determines an optimum sequence of color ink squirts based on the colors of source image data.

It is yet another object of the present invention to provide a color inkjet print apparatus which switches image processing on the source image data according to the order of color ink squirts that is selected based on predetermined information, thereby making the most of the merits associated with switching of the orders of ink squirts.

It is still another object of the present invention to provide a color inkjet print apparatus which attends to color correction by taking into account the switching of the orders of ink squirts in the memory-map interpolation method using a lookup table.

It is further another object of the present invention to provide a color inkjet print apparatus which selects the order of ink squirts by taking into account the gamut of reproducible colors, thereby making the most of the gamut of reproducible colors.

It is still another object of the present invention to provide a color inkjet print apparatus which selects the order of ink squirts that requires a least amount of ink consumption, thereby saving inks and avoiding the blurring of inks and the exuding of inks to the backside of a sheet.

It is yet another object of the present invention to provide a color inkjet print apparatus which selects the order of ink squirts by taking into account the gamut of reproducible colors and the amount of ink consumption, thereby making the most of the gamut of reproducible colors and saving inks.

It is still another object of the present invention to provide a color inkjet print apparatus which switches image processing according to the orders of ink squirts, thereby providing optimum image processing for each order of ink squirts.

It is further another object of the present invention to provide a color inkjet print apparatus which selects the order of ink squirts on a page-specific basis, thereby taking advantage of the switching of ink-squirt orders without requiring complex control.

It is yet another object of the present invention to provide a color inkjet print apparatus which selects the order of ink squirts on a pixel-specific basis or on a block-specific basis, thereby making the most of the effect of ink-squirt-order control.

It is yet another object of the present invention to provide a color inkjet print apparatus which selects an optimum order of ink squirts according to user needs.

To achieve these and other advantages in accordance with the purpose of the invention, the invention provides an apparatus for printing color inkjet images, including an image processing unit which processes source color data to generate output color data together with a signal indicative of an order of ink squirts in which a plurality of inks of respective colors are squirted onto a given pixel, and an inkjet print unit which is configured to squirt the plurality of inks in different orders of ink squirts, and prints color images based on the output color data by squirting the inks in the order of ink squirts indicated by the signal.

According to another aspect of the invention, the apparatus as described above is such that the image processing unit includes a lookup table which defines relationships between the source color data and the output color data at a plurality of points in a color space, and a color correction unit which interpolates the output color data at a given point in the color space between the data points, wherein the lookup table is configured such that some of the points in the color space are given two or more sets of the output color data.

According to another aspect of the invention, the apparatus as described above is such that the two or more sets of the output color data are positioned on or near a border between the different orders of ink squirts.

According to another aspect of the invention, the apparatus as described above is such that the image processing unit includes image processing units which correspond to the different orders of ink squirts, respectively, and process the source color data to generate respective output color data, and a selecting unit which selects the order of ink squirts from the different orders of ink squirts, and selects one of the image processing units accordingly, thereby outputting the output color data together with the signal indicative of the order of ink squirts.

According to another aspect of the invention, the apparatus as described above is such that the selecting unit selects the order of ink squirts on a page-specific basis.

According to another aspect of the invention, the apparatus as described above is such that the selecting unit selects the order of ink squirts on a pixel-specific basis.

According to another aspect of the invention, the apparatus as described above is such that the selecting unit selects the order of ink squirts on a block-specific basis.

According to another aspect of the invention, the apparatus as described above is such that the selecting unit refers to amounts of ink consumption required by the inkjet print unit to print the color images with respect to the different orders of ink squirts, and selects the order of ink squirts as requiring a least amount of ink consumption.

According to another aspect of the invention, the apparatus as described above is such that the selecting unit refers to a gamut of colors reproducible by the inkjet print unit with respect to each of the different orders of ink squirts, and selects the order of ink squirts as being optimum in terms of representing a gamut of colors of the source color data.

According to another aspect of the invention, the apparatus as described above is such that the selecting unit refers to a mode selected by a user, and selects the order of ink squirts as being optimum in view of the selected mode.

According to another aspect of the invention, the apparatus as described above is such that the inkjet print unit includes a plurality of nozzle lines, which are arranged in a main-scan direction, and are each comprised of a plurality of nozzles arranged in a sub-scan direction, the plurality of nozzle lines including two or more nozzle lines of the same ink color and at least one nozzle line of a different ink color between the two or more nozzle lines.

According to another aspect of the invention, the apparatus as described above is such that the plurality of nozzle lines are symmetrically arranged in respect of a center axis that extends perpendicularly to the main-scan direction.

According to another aspect of the invention, an apparatus for controlling image formation includes an image processing unit which processes source color data to generate output color data together with a signal indicative of an order of ink squirts in which a plurality of inks of respective colors are squirted onto a given pixel, and an inkjet print unit which is configured to squirt the plurality of inks in different orders of ink squirts, and prints color images based on the output color data by squirting the inks in the order of ink squirts indicated by the signal.

According to another aspect of the invention, a method of printing color inkjet images includes the steps of selecting an order of ink squirts based on source color data, processing the source color data to generate output color data, and printing color images based on the output color data by squirting inks from an inkjet print head in the selected order of ink squirts.

According to another aspect of the invention, the method as described above is such that the step of selecting the order of ink squirts includes the steps of obtaining a gamut of reproducible colors with respect to each of different orders of ink squirts, and selecting the order of ink squirts based on the obtained gamut of reproducible colors.

According to another aspect of the invention, the method as described above is such that the step of selecting the order of ink squirts includes the steps of obtaining amounts of ink consumption required for printing the color images with respect to different orders of ink squirts, and selecting the order of ink squirts based on the obtained amounts of ink consumption.

According to another aspect of the invention, the method as described above is such that the step of selecting the order of ink squirts includes the steps of obtaining a gamut of reproducible colors and amounts of ink consumption required for printing the color images with respect to each of different orders of ink squirts, and selecting the order of ink squirts based on the obtained gamut of reproducible colors and the obtained amounts of ink consumption.

According to another aspect of the invention, a method of printing color inkjet images, comprising the steps of selecting an order of ink squirts, switching image processing on source color data in response to the selected order of ink squirts, and printing color images based on the image-processed color data by squirting inks in the selected order of ink squirts.

According to another aspect of the invention, the method as described above is such that the inkjet print head includes a plurality of nozzle lines, which are arranged in a main-scan direction, and are each comprised of a plurality of nozzles arranged in a sub-scan direction, the plurality of nozzle lines including two or more nozzle lines of the same ink color and at least one nozzle line of a different ink color between the two or more nozzle lines.

According to another aspect of the invention, the method as described above is such that the plurality of nozzle lines are symmetrically arranged in respect of a center axis that extends perpendicularly to the main-scan direction.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

First Embodiment

Figure 1:
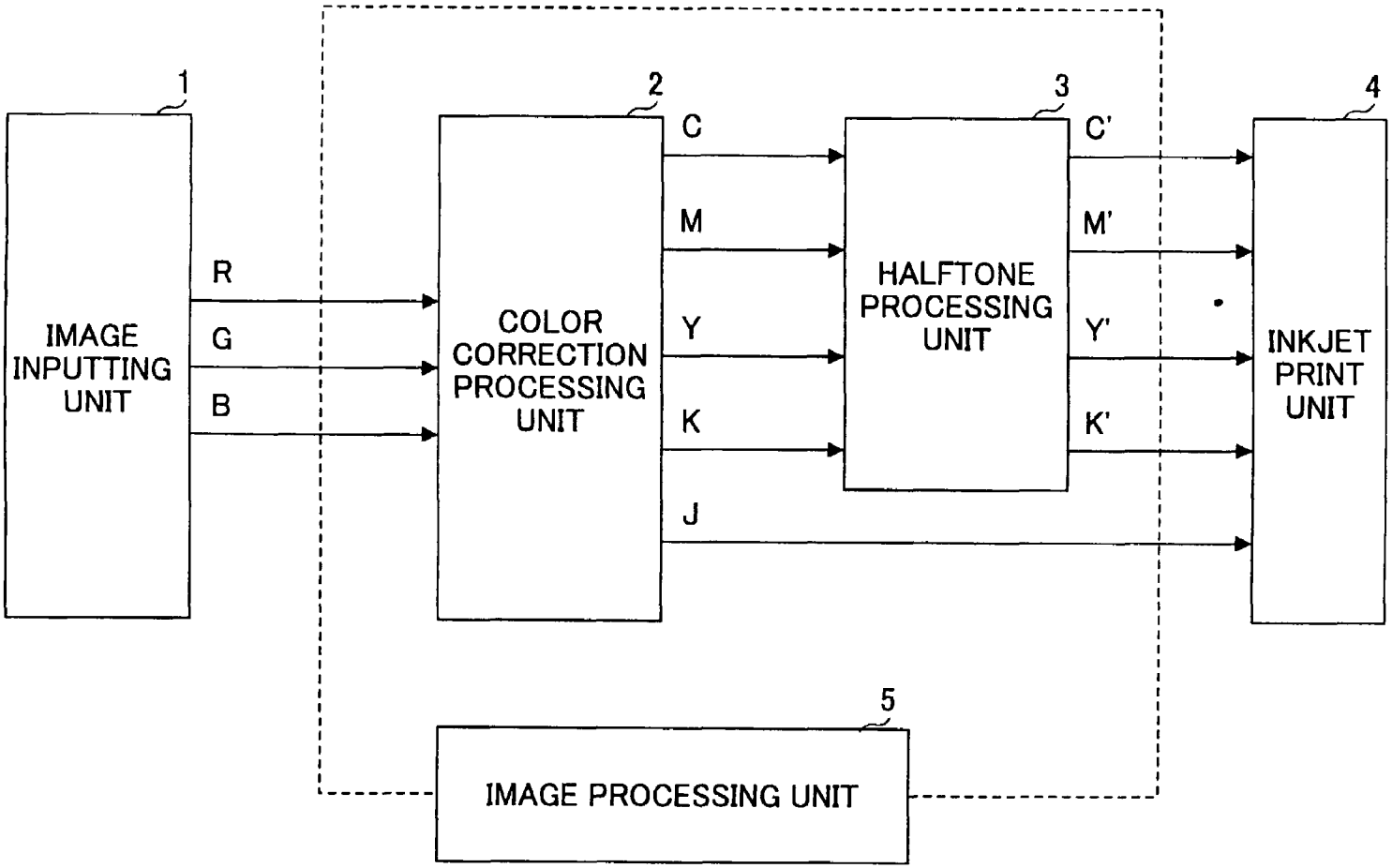
FIG. 1 is a block diagram showing the construction of a first embodiment of a color inkjet print apparatus according to the present invention.

FIG. 1 is a block diagram showing the construction of a first embodiment of a color inkjet print apparatus according to the present invention. The color inkjet print apparatus includes an image inputting unit 1, a color correction processing unit 2, a halftone processing unit 3, an inkjet print unit 4, and an image processing unit 5.

The inkjet print unit 4 may be of any type as long as it can squirt color inks in a plurality of different orders. In this embodiment, the inkjet print unit 4 has a head on which nozzle lines are arranged in the order of CMYK in the print direction, and is capable of printing on each way the head goes and returns. This head can change orders in which color inks are ejected, depending on whether it is on the way the head goes or on the way the head returns. When C and M are fired at the same position, for example, C follows M on the way the head goes, and M follows C on the way the head returns.

The image inputting unit 1 inputs color image data, which may be provided in the form of multi-value digital signals representing RGB colors. The image processing unit 5 involves color correction processing and halftone processing.

The color correction processing unit 2 converts the color input signals into CMYK signals, which correspond to ink colors. In this embodiment, the color correction processing unit 2 outputs not only the CMYK signals but also a signal J indicative of the order at which the color inks are squirted, which is different from a conventional configuration of color correction. With this provision, the order of ink squirts is determined in response to the color input signals, e.g., in response to the values of RGB. Such color correction processing with the determination of the order of ink squirts will be described later.

The halftone processing unit 3 receives CMYK signals having multi-values from the color correction processing unit 2, and converts them into C'M'Y'K' signals having such small values as can be printed by the inkjet print unit 4. In general, the inkjet print apparatus can accept binary values indicative of a squirt of a color ink or no squirt of a color ink in respect of a given pixel, or can accept tree-level values indicative of no dot, a small dot, or a large dot. Since the RGB signals of input image data and CMYK signals after color correction are multi-value data, they need to be converted into small values. Methods of converting into small values include a dither threshold method, an error diffusion method, and so on, as known in the art, any one of which may be employed in this embodiment.

As can be understood from the description of each unit, the inkjet print apparatus operates as follows. With the inputting of color image data, the image processing unit 5 generates color ink signals and the signal indicative of the order of ink squirts. In response to these signals, the inkjet print unit 4 ejects the color inks in the order of ink squirts, thereby forming an image. Here, pixels can be formed by a scan in one direction, which includes a scan achieved by the movement of a print sheet.

Figure 2:
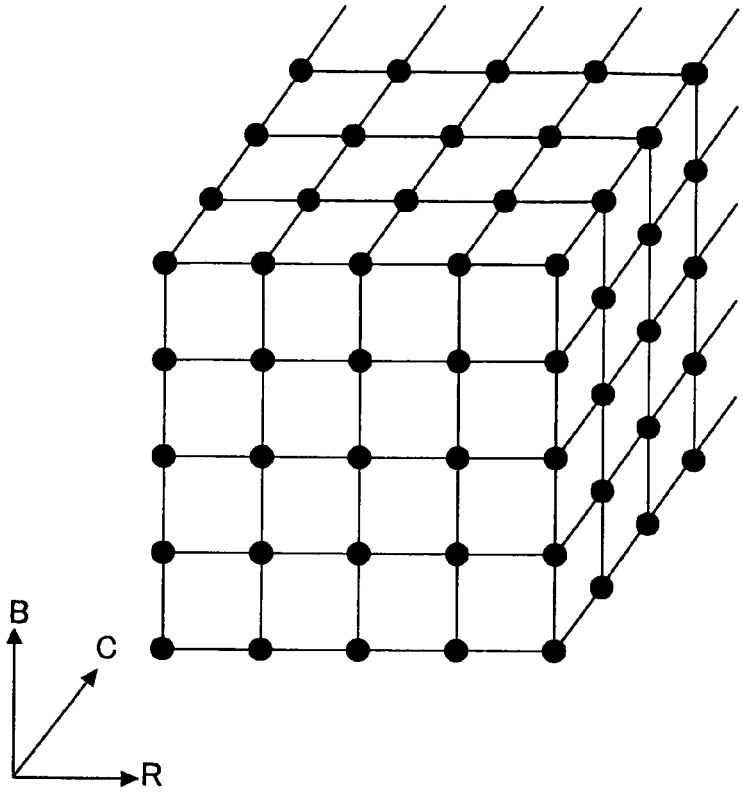
FIG. 2 is an illustrative drawing showing a source RGB color space which are divided into cubes.

In what follows, a detailed description will be given of the color correction processing unit 2. The methods of color correction include a method based on color masking, a method based on the interpolation of table reference values stored in memory, etc. In this embodiment, the memory interpolation method will be employed. This method divides a source color space into a plurality of three-dimensional figures such as cubes and triangle poles, and stores the values of CMYK color correction in table memory in respect of vertexes of each three-dimensional figure. FIG. 2 is an illustrative drawing showing the source RGB color space which are divided into cubes. As shown in FIG. 2, the source RGB color space is divided into cubes, and the values of CMYK color correction are assigned to individual grid points. A value of CMYK color correction for source color components that are positioned inside a three-dimensional figure is computed by linier interpolation of the values of color correction that are provided at the vertexes of the three-dimensional figure.

This embodiment uses the signal indicative of the order of ink squirts in addition to the values of CMYK color correction. This signal may assume "0" if the inks are to be ejected in the order of ink squirts that is defined for the way the head goes, and may assume "1" if the inks are to be ejected in another order of ink squirts that is defined for the way the head returns. Such 1-bit signal is stored also in table memory.

In the following, a description will be given of how to generate a color-correction table. Here, the order of ink squirts is selected such as to maximize the gamut of reproducible colors.

Figure 3:
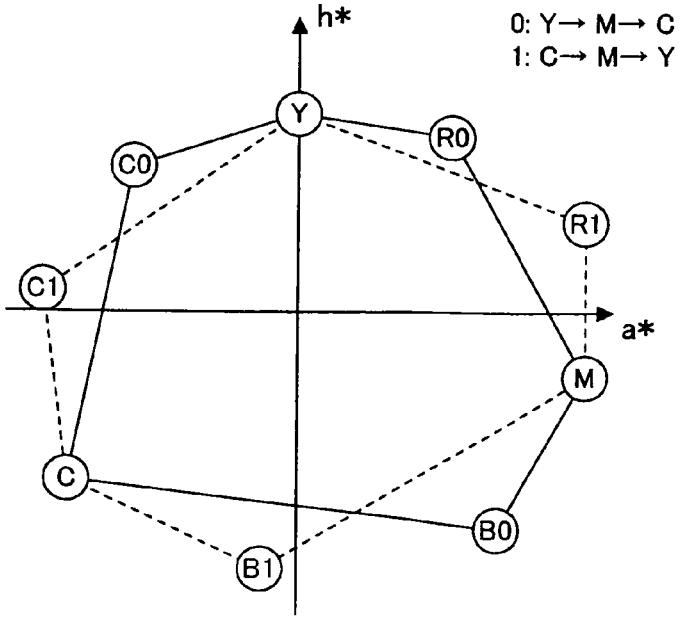
FIG. 3 is a chart showing the gamut of reproducible colors for different orders of ink squirts.

The orders of ink squirts are determined first, and, then, a CMYK color correction table is generated with respect to each order of ink squirts. In this embodiment, however, processing such as the gamut compression is not performed in respect of non-reproducible colors, refraining from setting the values of CMYK color correction. Different orders of ink squirts result in the different gamut of reproducible colors. Specifically, colors squirted earlier tend to be dominant compared with colors squirted later. FIG. 3 is a chart showing the gamut of reproducible colors for different orders of ink squirts. The source color space is an L*a*b* space, and the gamut of colors is illustrated on the a*b* plane for the sake of simplicity. Here, the gamut of reproducible colors is represented by a hexagon having 6 basic hues (CMYRGB) at its vertexes. R0 and R1 are the points where M=Y=max and C=0, and G0 and G1 are the points where Y=C=max and M=0. Also, B0 and B1 are the points where C=M=max and Y=0. Here, 0 and 1 signify the first order of ink squirts (Y, M, C on the way it goes) and the second order of ink squirts (C, M, Y on the way it returns), respectively. Two points such as R0 and R1 have different hues despite the fact that the same amount of inks is used. This is because hues are dependent on the orders of ink squirts, with the colors ejected earlier being dominant than the colors ejected later. As shown in FIG. 3, the gamut of colors varies, which means that certain colors are only reproducible by a particular order of ink squirts. For such colors, the order of ink squirts that can reproduce those particular colors is used. In this manner, the squirt-order indicating signal "0" or "1" is added to the CMYK color correction table.

Figure 4:
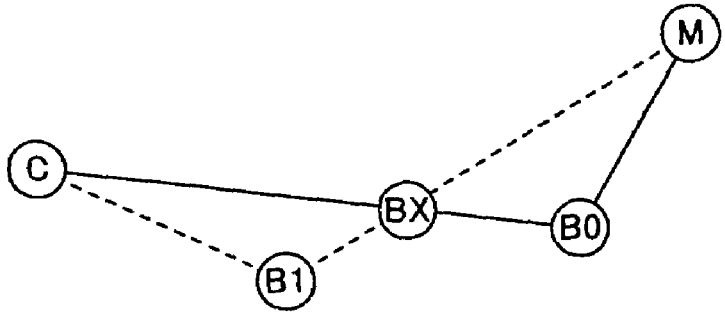
FIG. 4 is an illustrative drawing showing borders on which CM hue changes.

Consideration should be given to the borders on which the order of ink squirts changes. FIG. 4 is an illustrative drawing showing the borders on which CM hue changes. A detailed description will be given here with reference the example of CM hue. An intersection of a line C-B0 and a line M-B1 is denoted as BX. An area M-B0-BX needs to have the first order of ink squirts, and the area C-B1-BX needs to have the second order of ink squirts, for the purpose of maximizing the gamut of reproducible colors. Here, the line C-BX may be selected as the border on which the orders of ink squirts change, with only the area C-B1-BX being printed with the second order of ink squirts, and other areas being printed with the first order of ink squirts.

Figure 5:
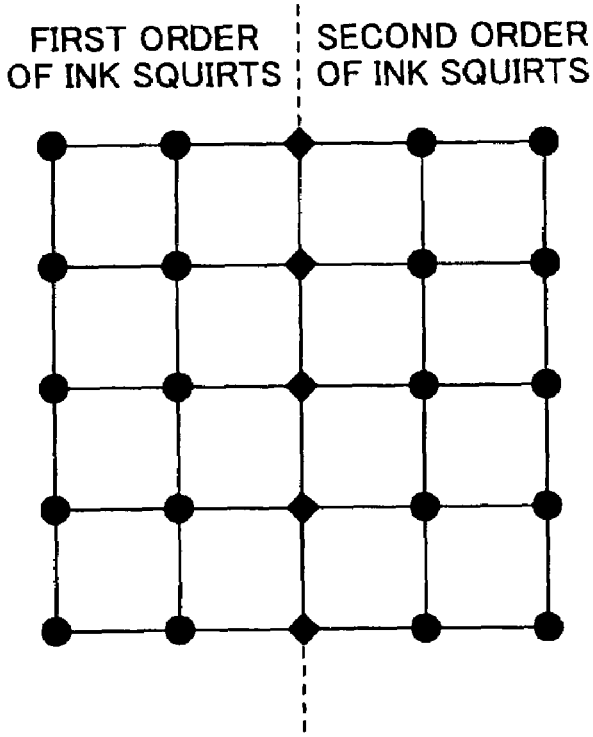
FIG. 5 is an illustrative drawing for explaining a method of setting color correction values on the border of changes.

In the following, a method of setting color correction values on the border of changes will be described with reference to FIG. 5. FIG. 5 is an illustrative drawing for explaining a method of setting color correction values on the border of changes. For the sake of simplicity of illustration, the source color space is represented in a two-dimensional plane. A dotted line represents the border of changes. Consideration is given to a case in which a color correction value is to be computed by linear interpolation inside a 3-dimensional figure abutting the border. When the left-hand side of the border is considered, color correction values for the first order of ink squirts need to be set at the vertexes along the border. When the right-hand side of the border is considered, color correction values for the second order of ink squirts are needed. In this manner, two sets of color correction values need to be set on the border, which is quite different from conventional color correction. These two sets are selectively used depending on whether the first order of ink squirts is employed or the second order of ink squirts is employed. The signal indicative of the order of ink squirts can also be obtained through linear interpolation. Since this signal is comprised of only one bit, a simpler method may be employed, such as a method that selects a proper value among a plurality of values.

As described above, an optimum order of ink squirts is selected in response to the source color signals, thereby making the most of the gamut of reproducible colors.

Although the order of ink squirts is determined such as to maximize the gamut of colors in this embodiment, it is not limited to a particular order with respect to the gamut of colors that can be reproduced by any order of ink squirts. When an identical color is reproduced in such an color region, the amount of inks may vary depending on the order of inks squirts. In such a case, the order of ink squirts is determined such as to use a less amount of inks. This can reduce ink consumption, and can also avoid problems such as the blurring of images and the exuding of inks to the backside of sheets.

Second Embodiment

Figure 6:
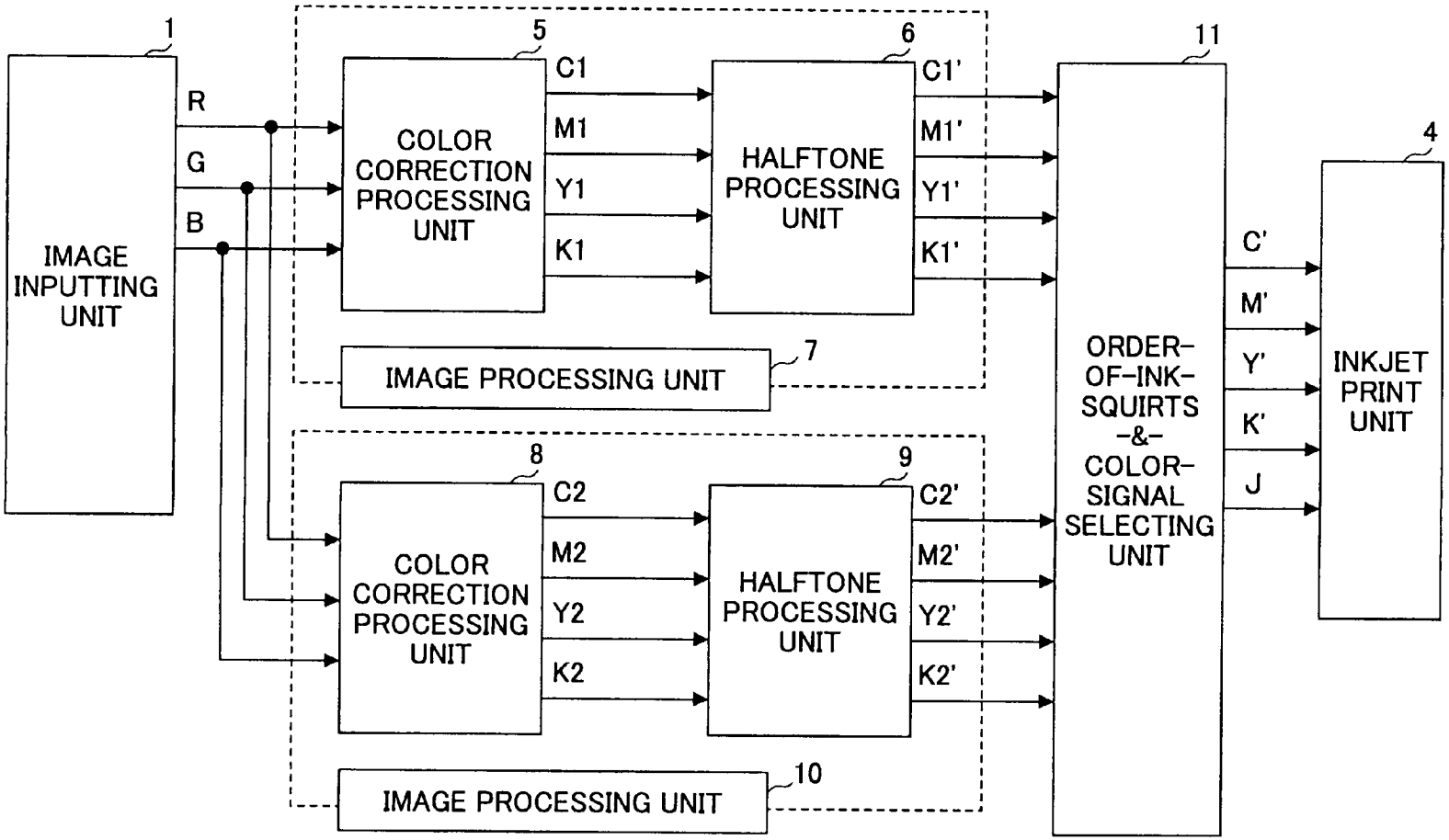
FIG. 6 is a block diagram showing the construction of a second embodiment of a color inkjet print apparatus according to the present invention.

FIG. 6 is a block diagram showing the construction of a second embodiment of a color inkjet print apparatus according to the present invention. This embodiment differs from the first embodiment in that two image processing units 7 and 10 are provided, which correspond to the two orders of ink squirts, respectively, one for the way the head goes and the other for the way the head returns. The orders of ink squirts and the image processing units are switched according to predetermined information. In detail, signals processed by either the image processing unit 7 or the image processing unit 10 are selected by an order-of-ink-squirts-&-color-signal selecting unit 11.

The image processing units 7 and 10 include color correction units 5 and 8 and halftone processing units 6 and 9, respectively. Although this embodiment is provided with only two image processing units, the number of the processing units is not limited to two, and may be any number corresponding to the number of selectable orders of ink squirt sequences.

The predetermined information that is input to the order-of-ink-squirts-&-color-signal selecting unit 11 may vary. In this embodiment, information indicative of the amount of ink consumption is used. The amount of ink consumption is determined with respect to each order of ink squirts that is to be used for printing of input image data, and the order of ink squirts that requires a less amount of inks is selected so as to save ink consumption. The less amount of inks can avoid the blurring of images and the exuding of inks to the backside of sheets.

In order to obtain the amount of ink consumption, image processing corresponding to each order of ink squirts is performed on input image data. This produces data having undergone color correction and halftone processing with respect to each order of ink squirts. It is easy to obtain the amount of ink consumption from the data obtained in this manner. For the sake of simplicity, the inkjet print unit 4 may be controlled by binary values, each indicating whether a constant amount of ink is squirted for each color. In such a case, the data having undergone the halftone processing assumes either a value "0" or a value "1". When the values of CMYK are added together for a given pixel, the obtained total represents the amount of ink consumption for this pixel. Since the signals processed by the image processing units 7 and 10 are supplied to the order-of-ink-squirts-&-color-signal selecting unit 11, these signals are added together for the entirety of one page. The signals corresponding to the less amount of ink consumption are then selected for transmission to the inkjet print unit 4 along with the signal indicative of the order of ink squirts.

Although this embodiment is configured to switch the orders of ink squirts on a page-by-page basis, provision may alternatively be made to switch the orders of ink squirts on a pixel-by-pixel basis or on a block-by-block basis. In such a case, the amount of ink consumption is determined on a pixel-specific basis or on a block-specific basis, and, then, a comparison is made to select the order of ink squirts.

Third Embodiment

Figure 7:
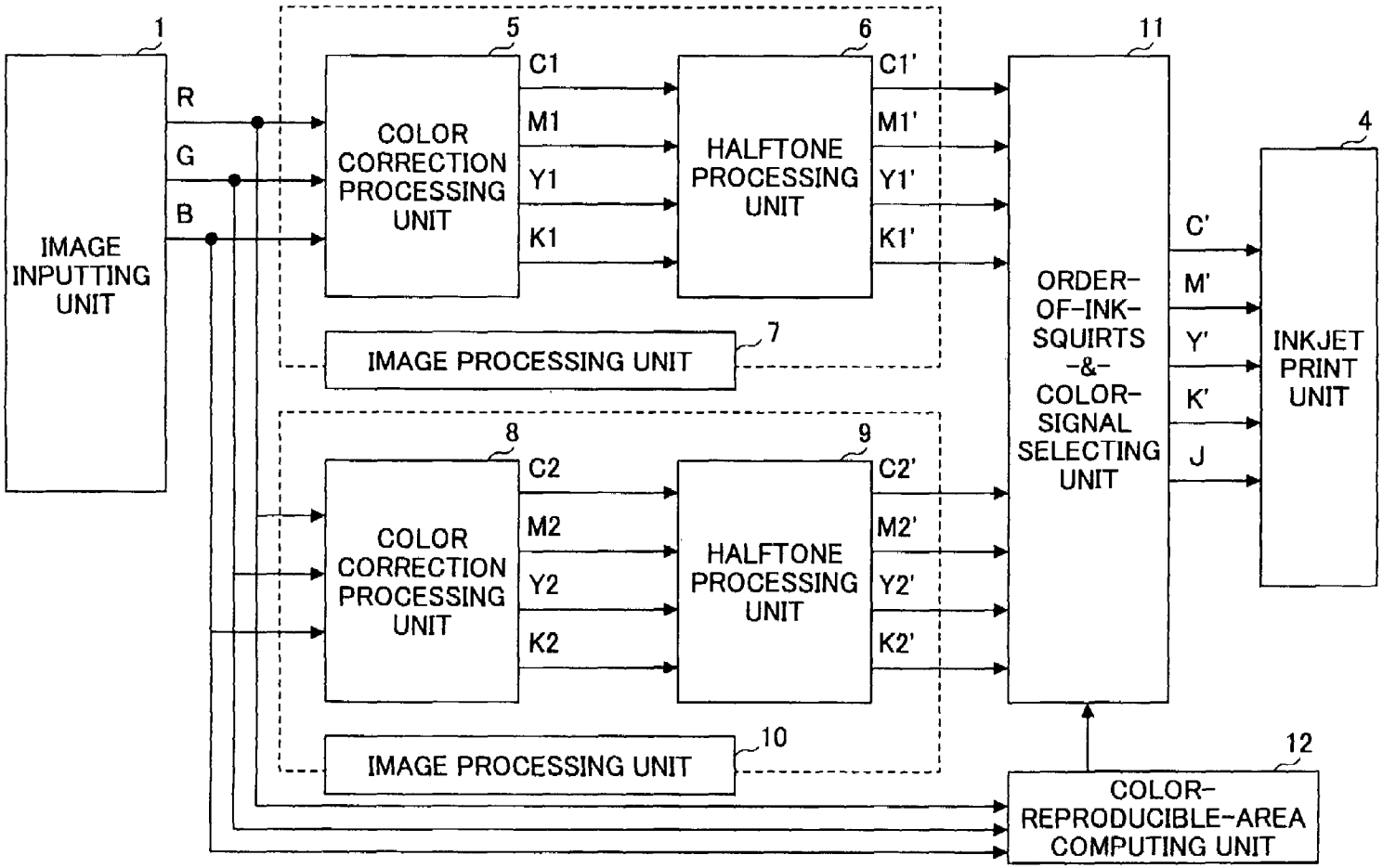
FIG. 7 is a block diagram showing the construction of a third embodiment of a color inkjet print apparatus according to the present invention.

FIG. 7 is a block diagram showing the construction of a third embodiment of a color inkjet print apparatus according to the present invention. This embodiment has a construction similar to that of the second embodiment. As the predetermined information, however, information indicative of the gamut of colors of source image data is used. Namely, the gamut of colors necessary for reproduce the input image data is obtained, and, then, the order of ink squirts suitable to reproduce the gamut of colors is selected. In detail, the gamut of reproducible colors is recorded for each order of ink squirt as a gamut outer boundary in the source RGB space. A color-reproducible-area computing unit 12 compares these gamut outer boundaries with the gamut outer boundary of the input image data, thereby selecting the order of ink squirts that has least non-reproducible color regions within the gamut of colors of input image data.

When the input image data is generated by a personal computer or the like, generally, the gamut of colors tends to be wider than the reproducible output colors of the inkjet print apparatus or the like. This is because the gamut of reproducible colors by the PC display differs from the gamut of reproducible colors by the color inks, with the gamut of colors of the PC display being wider. When the inkjet print apparatus is used, therefore, colors of the input image data that cannot be reproduced are mapped onto the gamut of reproducible colors, which undesirably changes the appearance of colors. According to this embodiment, however, the order of ink squirts is selected such as to secure the widest gamut of reproducible colors, which minimizes the drawbacks described above.

Although this embodiment is configured to switch the orders of ink squirts on a page-by-page basis, provision may alternatively be made to switch the orders of ink squirts on a pixel-by-pixel basis or on a block-by-block basis. In such a case, one of the orders of ink squirts may be chosen as a default order. If the default order of ink squirts cannot represent an input color, and if another order of ink squirts can reproduce such a color, the orders of ink squirts are switched accordingly.

Fourth Embodiment

This embodiment is provided with an image processing unit for two-way printing in addition to the construction of the second and third embodiments. That is, this embodiment is provided with three image processing units for the way the head goes, for the way the head returns, and for each way the head goes and returns. The two-way image processing unit is used for printing on each way the head goes and returns without regard to a difference of colors caused by the varying orders of ink squirts. In other words, this embodiment is provided with the image processing unit for printing only on the way the head goes and the image processing unit for printing only on the way the head returns, in addition to the inkjet print apparatus that prints on each way the head goes and returns.

With this provision, two-way printing is generally performed to achieve high print speed. A one-way printing is performed when printing a color that can only be reproduced by a particular order of ink squirts, thereby making the most of the gamut of reproducible colors.

Such operation is also applicable to the construction of the first embodiment. For example, the color correction table may be set such that the area M-B0-BX and the area C-B1-BX shown in FIG. 4 are reproduced by one-way printing, and other areas reproducible by either order of ink squirts are reproduced by two-way printing. Specifically, the signal indicative of the order of ink squirts may be given three signal levels, e.g., "0" for printing on the way the head goes, "1" for printing on the way the head returns, and "2" for printing on each way the head goes and returns, with CMYK values being set accordingly.

Fifth Embodiment

Figure 8:
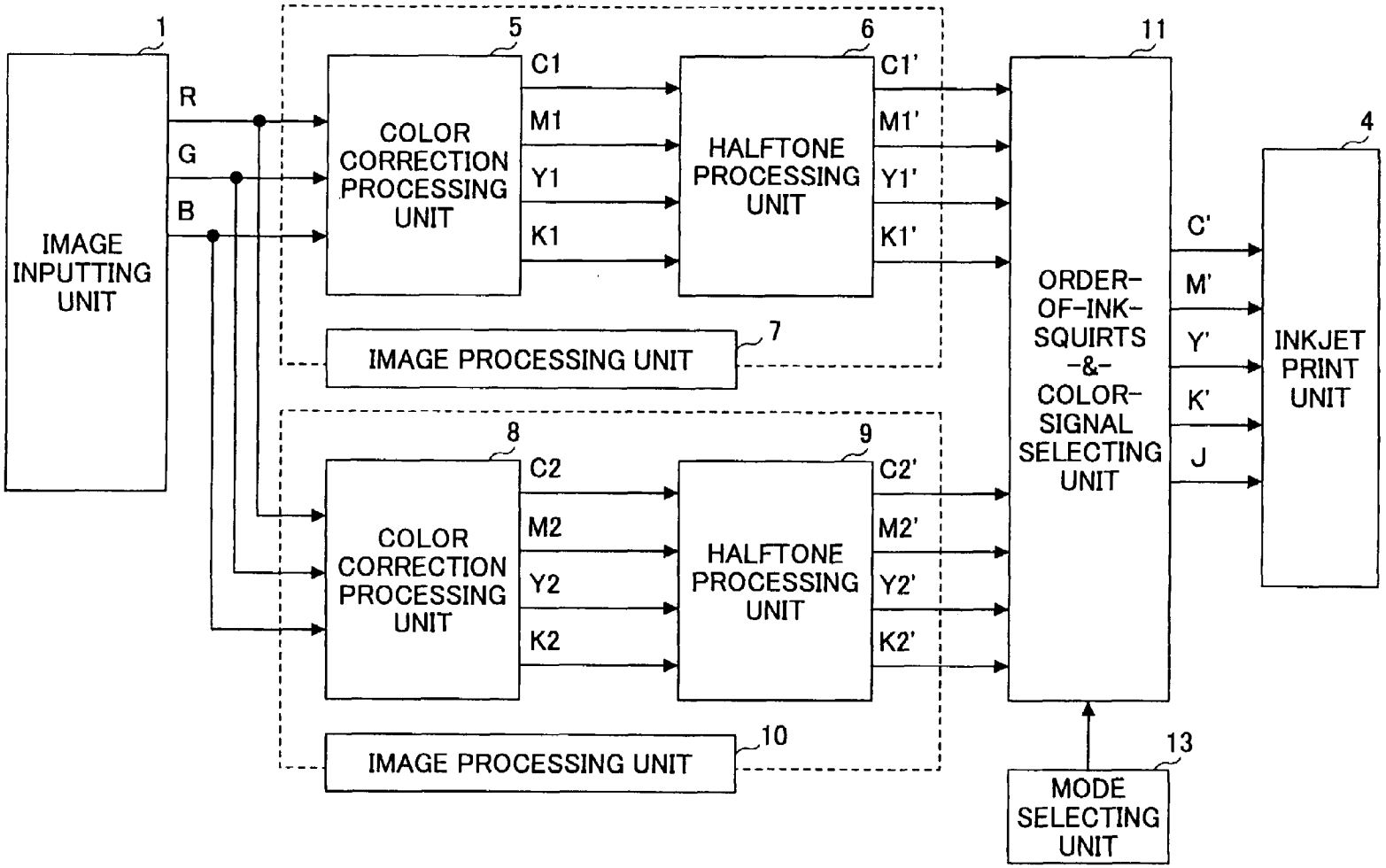
FIG. 8 is a block diagram showing the construction of a fifth embodiment of a color inkjet print apparatus according to the present invention.

FIG. 8 is a block diagram showing the construction of a fifth embodiment of a color inkjet print apparatus according to the present invention. This embodiment is provided with a mode selecting unit 13, which switches the orders of ink squirts in response to a mode instruction given by a user. Such configuration is applicable to the construction of the second through fourth embodiments. A user-specified mode may include an quality-preferred mode, a speed-preferred mode, and a ink-saving mode. As in the fourth embodiment, provision may be made to achieve three types of printing, i.e., printing on the way the head goes, printing on the way the head returns, and printing on each way the head goes and returns. In the case of the quality-preferred mode, an optimum order of ink squirts is selected by factoring into the gamut of reproducible colors as in the third embodiment. In the case of the speed-preferred mode, two-way printing is selected to achieve high speed printing. In the case of the ink-saving mode, an order of ink squirts is selected such as to keep ink consumption to a minimum.

In this manner, an optimum order of ink squirts is selected in accordance with user needs.

Sixth Embodiment

Figure 9:
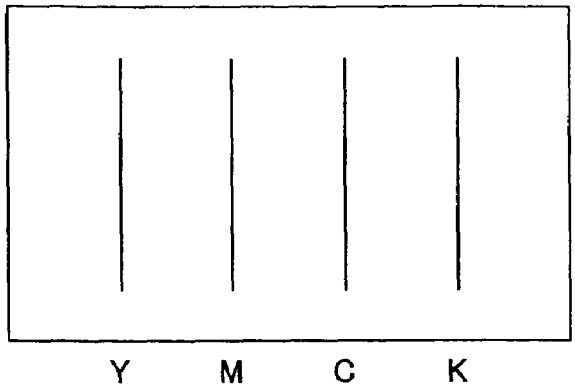
FIG. 9 is an illustrative drawing showing a head that has nozzle lines of respective colors arranged in a print direction.

The previous embodiments have been described with reference to a head which has nozzle lines of respective colors (e.g., CMYK) arranged in the print direction as shown in FIG. 9. With this head, the orders of ink squirts are changed between the way the head goes and the way the head returns. Because of this, only one-way printing is possible if a particular order of ink squirts is selected, which results in slower printing speed compared to two-way printing.

In order to avoid such lowering of printing speed, two or more nozzle lines of the same ink color may be provided with respect to inks for which the gamut of reproducible colors needs to be expanded. Between these two or more nozzle lines, one or more nozzle lines of other ink colors are provided.

Figure 10:
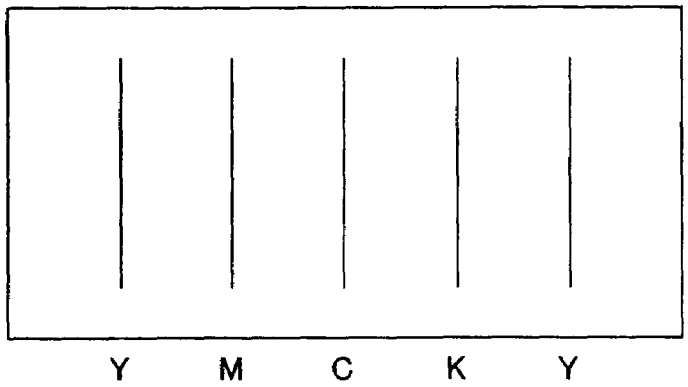
FIG. 10 is an illustrative drawing showing a head on which nozzle lines of C ink and M ink are arranged between nozzle lines of Y ink.

As shown in FIG. 10, for example, nozzle lines of C ink and M ink are arranged between nozzle lines of Y ink. This makes it possible to either superimpose Y on C or superimpose C on Y, whichever is desired, irrespective of the way, i.e., whether the way the head goes or the way the head returns. Regardless of the way the head moves, M may be superimposed on Y, or Y may be superimposed on M. In this manner, two-way printing is achieved while expanding the gamut of reproducible colors. This achieves high-speed printing of color images having a wide gamut of colors.

Figure 11:
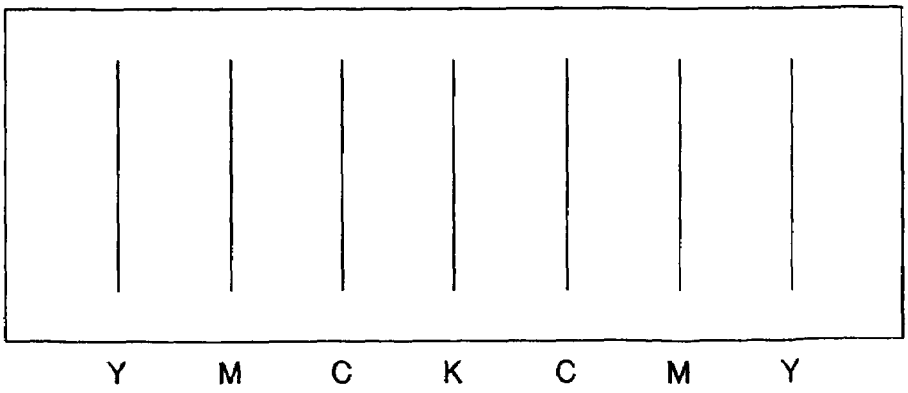
FIG. 11 is an illustrative drawing showing a head on which nozzle lines of respective colors are arranged symmetrically in respect of a center axis that extends perpendicularly to the main scan direction.

As shown in FIG. 11, nozzle lines of respective colors may be arranged symmetrically in respect of a center axis that extends perpendicularly to the main scan direction. With this provision, two or more color inks can be superimposed in an arbitrary order regardless of the way, i.e., whether the way the head goes or the way the head returns. In this manner, two-way printing is achieved while further expanding the gamut of reproducible colors. This achieves high-speed printing of color images having a wider gamut of colors.

Figure 12:
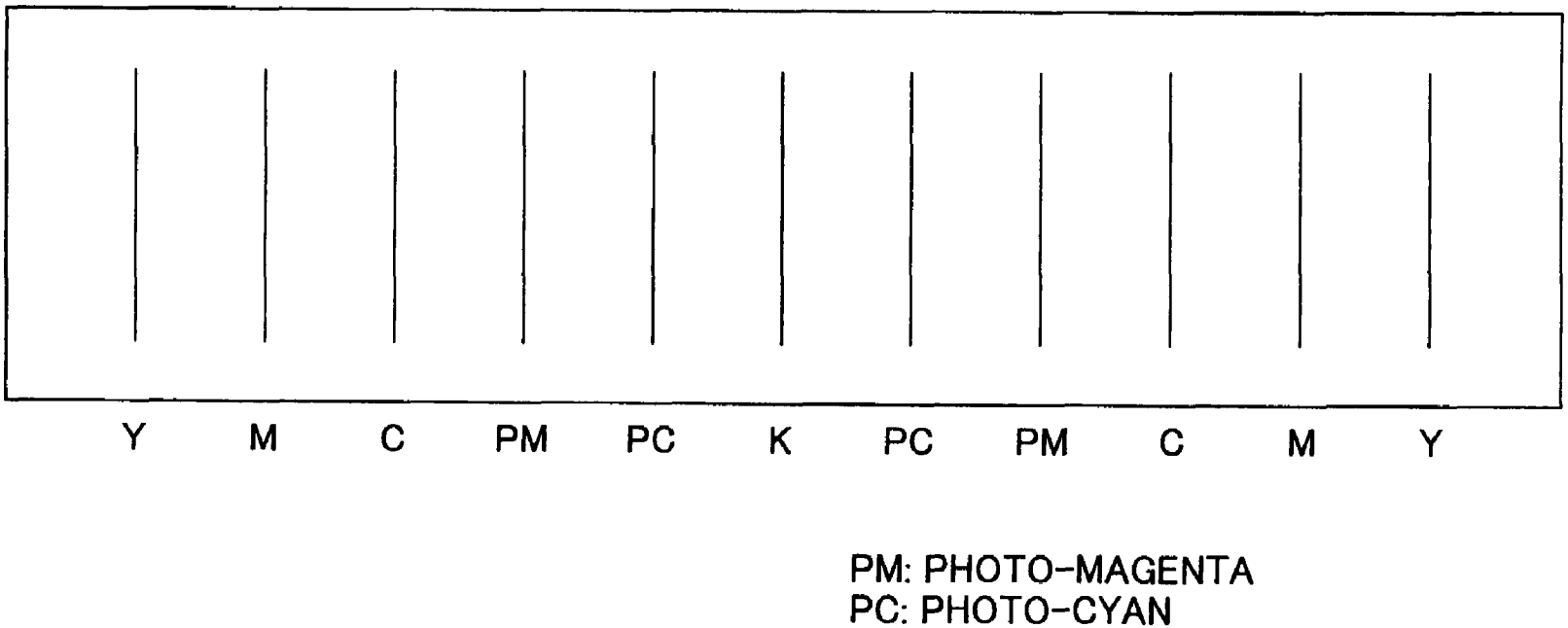
FIG. 12 is an illustrative drawing showing a head on which low-chromaticity yellow, magenta, cyan, and black inks are provided in addition to conventional yellow, magenta, cyan, and black inks.

As shown in FIG. 12, low-chromaticity yellow, magenta, cyan, and black inks (i.e., photo-yellow, photo-magenta, photo-cyan, and photo-gray, respectively) may be provided in addition to conventional yellow, magenta, cyan, and black inks. With use of the low-chromaticity inks, the gamut of reproducible colors is expanded, and, also, color prints having less granularity are obtained.

Seventh Embodiment

The previous embodiments are directed to the configuration in which four ink colors, i.e., CMYK, are used. Alternatively, the present invention is applicable to a configuration in which six colors are used, including lighter C ink and M ink (often referred to as light cyan and light magenta, respectively) in addition to those four colors. The invention is further applicable to a configuration in which special colors such as gold, silver, orange, etc., are added for the purpose of reproducing particular colors or for the purpose of expanding the gamut of reproducible colors.

Eighth Embodiment

Inkjet print apparatuses include a serial-type inkjet printer and a line-type inkjet printer as classified according to the configuration of inkjet heads. The serial-type inkjet printer scans an inkjet head in the traverse direction of a paper sheet (i.e., in the main scan direction) so as to print images, and moves the paper sheet after the completion of one or more scans so as to print images on the next print line. The line-type inkjet printer has nozzles provided along all the width of a paper sheet, and prints images by moving the paper sheet without performing a scan in the traverse direction of the paper sheet. The first through seventh embodiments described above are applicable to both types of printers.

In the following, these two types of printers will be described.

Figure 13:
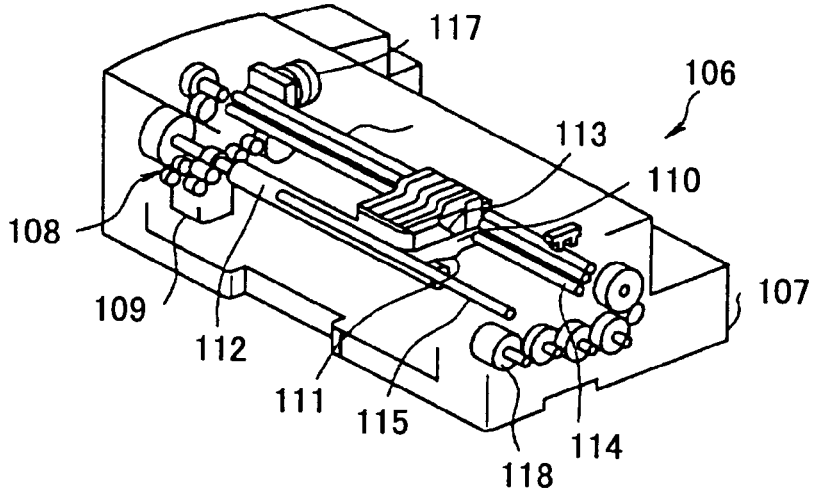
FIG. 13 is a perspective view of a serial-type inkjet printer to which the invention is applied.

FIG. 13 is a perspective view of a serial-type inkjet printer to which the invention is applied. As shown in FIG. 13, a carriage 110 accommodates cartridges 113, each of which carries processing solution and print solution, separately. The cartridges 113 are separately provided for respective colors, with each solution being separately stored. The processing solution and the print solution are supplied from the cartridges 113 to a print head 111, which is mounted on the carriage 110. In FIG. 13, a print surface of the print head 111 is facing downward, thus failing to appear in the view.

The print head 111 mounted on the carriage 110 moves along guide shafts 114 and 115 by a timing belt 16 driven by a main-scan motor 17. A sheet on which images are to be printed is provided by a platen 112 to face the print head 111. FIG. 13 further shows a gear mechanism 108, a sub-scan motor 109, and a sustaining mechanism motor 118.

Figure 14:
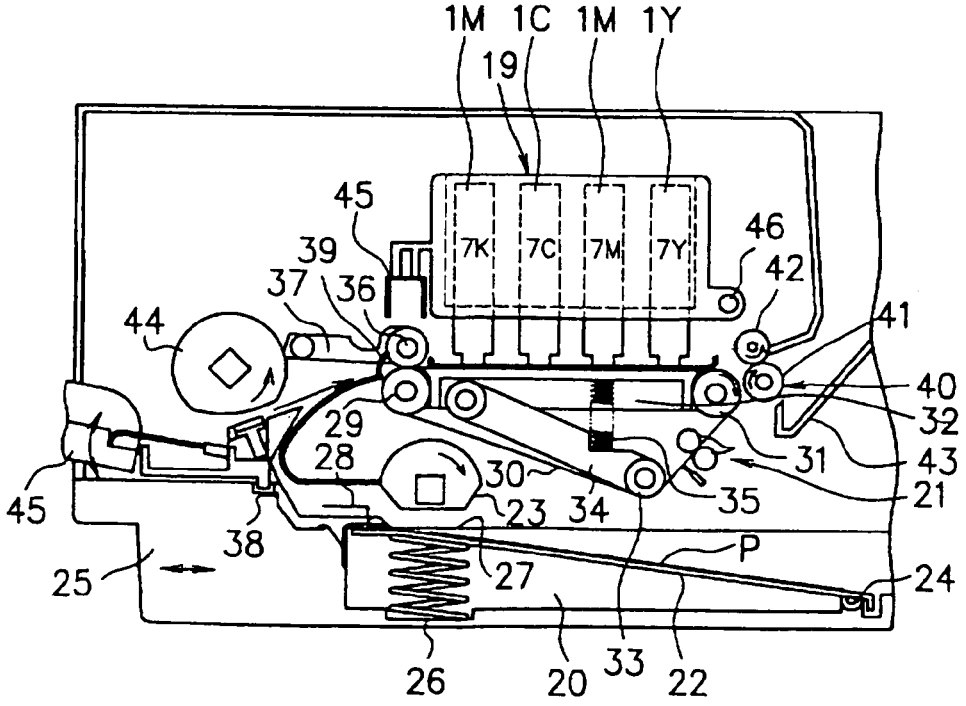
FIG. 14 is a cross-sectional view showing the entire construction of a line-type inkjet printer.

FIG. 14 is a cross-sectional view showing the entire construction of a line-type inkjet printer. The line-type inkjet printer includes an automatic feeder apparatus, and includes a feeder unit 20, a sheet conveying unit 21 (belt-conveyer apparatus), a sheet ejecting unit 40, and an inkjet head unit 19. Ink tanks, ink cartridges, pumps, etc. are also provided. In the following, a description will be given of (A) the feeder unit, (B) the sheet conveying unit, (C) the print head unit, and (D) the sheet ejecting unit in this order.

(A) Feeder Unit

The feeder unit 20 includes a pressure plate 22 and a feeder roller 23 mounted on a base 24. The pressure plate 22 carries a stack of paper sheets P, and the feeder roller 23 feeds the paper sheets P. The pressure plate 22 is movably mounted to the base 24, and is urged against the feeder roller 23 by a pressure-plate spring 26. A portion of the pressure plate 22 that faces the feeder roller 23 is provided with a separation pad 27, which is made of a material having a large coefficient of friction, thereby preventing more than one sheet P from being simultaneously fed. The base 24 is provided with a separating tab 28, which covers a corner of the paper sheets P, and serves to separate the paper sheets P one from the other. The base 24 is further provided with a release cum (not shown) for releasing the feeder roller 23 from the pressure plate 22.

In the construction described above, the release cum pushes the pressure plate 22 down to a predetermined position. This releases the feeder roller 23 from the pressure plate 22. The driving force of the conveyer roller 29 is then transmitted by gears or the like to the feeder roller 23 and the release cum, resulting in the release cum being separated from the pressure plate 22, which causes the pressure plate 22 to rise, with the feeder roller 23 coming in contact with the paper sheets P. As the feeder roller 23 rotates, one of the paper sheets P is picked up for feeding, and is separated from the rest of the sheets P by the separating tab 28 for transmission to the sheet conveying unit 21.

The feeder roller 23 rotates until the paper sheet P reaches the sheet conveying unit 21. The feeder roller 23 is then placed in a standby state after loosing contact with the paper sheets P, with the driving force of the conveyor roller 29 being cut off. A feeder roller 44 is used for manual feeding. The feeder roller 44 feeds the paper sheets P on a manual-feed tray 45 to the conveyor roller 29 in response to a print instruction signal from a computer.

(B) Sheet Conveying Unit

The sheet conveying unit 21 includes a PE sensor (i.e., a paper-edge sensor such as a photo coder or the like) and a conveyor belt 30, which has a hold surface that sticks to the paper sheet P for the purpose of carrying the sheet. The conveyor belt 30 is driven by a drive roller 31, and is hooked around the conveyor roller 29 and a pressure roller 33. The conveyor roller 29 and the drive roller 31 are rotatably mounted to a platen 32. The pressure roller 33 is rotatably mounted to one end of an arm 34, which has another end mounted to the platen 32 such as to allow swing movement. The arm 34 is pressed down by a spring 35, thereby providing a tension to the conveyor belt 30. The platen 32 is situated under the conveyor belt 30, and serves to support the conveyor belt 30.

A pinch roller 36 is provided at a position that faces the conveyor roller 29, and rotates in conjunction with the conveyor belt 30. The pinch roller 36 is pressed against the conveyor belt 30 by a spring (not shown), thereby guiding the paper sheet P to a print unit.

Further, an upper guide 37 and a lower guide 38 are provided at the inlet of the sheet conveying unit 21 that receives the paper sheet P, for the purpose of guiding the paper sheet P. The upper guide 37 is provided with a PE sensor lever 39, which informs the PE sensor of the detection of a head end and a tail end of the paper sheet P. The inkjet head unit 19 that forms images based on image information is provided downstream relative to the conveyor roller 29 in the travel direction of the paper sheet P.

In the construction as described above, the paper sheet P heading toward the sheet conveying unit 21 is guided by the upper guide 37 and the lower guide 38, and reaches a pair of rollers comprised of the conveyor roller 29 and the pinch roller 36. The PE sensor lever 39 detects the head end of the paper sheet P as it travels, thereby determining the position where the paper sheet P is printed. The paper sheet P is carried by the rotation of the conveyor belt 30, which is driven through the conveyor roller 29 by a paper-sheet feeding motor.

(C) Print Head Unit

The inkjet head unit 19 of this embodiment is a full-line-type inkjet print head on which a plurality of nozzles for squirting inks are arranged along the full width of a print area in the direction (traverse direction) perpendicular to the travel direction of the paper sheet P. In FIG. 14, an example of head-unit arrangement is illustrated. The inkjet head unit 19 has 1Y (yellow), 1C (cyan), 1M (magenta), and 1Y (yellow) arranged in this order at predetermined intervals from upstream to downstream in the travel direction of the paper sheet P.

The inkjet head unit 19 includes electro-thermo energy converter such as a heater that heats inks. The inks are boiled by heat, which results in changes of pressures being caused by the enlargement or shrinkage of bubbles. The changes of pressures cause the inks to squirt from the nozzles, thereby forming images on the print sheet P. The inkjet head unit 19 has one end that is rotatably attached to a rod 46, and has the other end that is provided with a head holder. The head holder engages rails 45, thereby defining the distance between the nozzles and the paper sheet P.

(D) Sheet Ejecting Unit

The sheet ejecting unit 40 is comprised of a sheet ejecting roller 41 and a spurring roller 42. The paper sheet P carrying images formed by the print unit is clamped and carried by the sheet ejecting roller 41 and the spurring roller 42 for ejection onto a sheet ejection tray 43.

Further, the present invention is not limited to these embodiments, but various variations and modifications may be made without departing from the scope of the present invention.

The present application is based on Japanese priority application No. 2002-269175 filed on Sep. 13, 2002 and Japanese priority application No. 2003-169256 filed on Jun. 13, 2003, with the Japanese Patent Office, the entire contents of which are hereby incorporated by reference.

What is claimed is:

1. An apparatus for printing color inkjet images, comprising:

an input unit configured to input color image data; and an image processing unit configured to perform image processing on the color image data, said apparatus characterized in that a control unit is provided that is operable to control an order of ink squirts in which a plurality of inks of respective colors are squirted onto a given pixel in response to a color range required for the color image data, by use of a plurality of different orders.

2. The apparatus as claimed in claim 1, wherein said control unit is configured to control the order of ink squirts separately for each page of the input color image data.

3. The apparatus as claimed in claim 2, characterized in that an inkjet recording unit is provided that is operable to squirt the plurality of inks of respective colors onto a give pixel in the plurality of different orders, said inkjet recording unit including:

a plurality of nozzle lines arranged in a main scan direction, each of the nozzle lines including a plurality of nozzles arranged in a sub-scan direction, the nozzle lines including at least two nozzle lines for squirting an ink of the same color, and at least one nozzle line for squirting an ink of a different color situated between said at least two nozzle lines.

4. The apparatus as claimed in claim 3, wherein said inkjet recording unit is configured such that said at least two nozzle lines for squirting an ink of the same color are arranged symmetrically with respect to an axis perpendicular to the main scan direction.

5. The apparatus as claimed in claim 1, wherein said control unit is configured to control the order of ink squirts separately for each pixel or block of the input color image data.

6. The apparatus as claimed in claim 5, characterized in that an inkjet recording unit is provided that is operable to squirt the plurality of inks of respective colors onto a give pixel in the plurality of different orders, said inkjet recording unit including:

a plurality of nozzle lines arranged in a main scan direction, each of the nozzle lines including a plurality of nozzles arranged in a sub-scan direction, the nozzle lines including at least two nozzle lines for squirting an ink of the same color, and at least one nozzle line for squirting an ink of a different color situated between said at least two nozzle lines.

7. The apparatus as claimed in claim 6, wherein said inkjet recording unit is configured such that said at least two nozzle lines for squirting an ink of the same color are arranged symmetrically with respect to an axis perpendicular to the main scan direction.

8. The apparatus as claimed in claim 1, characterized in that an inkjet recording unit is provided that is operable to squirt the plurality of inks of respective colors onto a give pixel in the plurality of different orders, said inkjet recording unit including:

a plurality of nozzle lines arranged in a main scan direction, each of the nozzle lines including a plurality of nozzles arranged in a sub-scan direction, the nozzle lines including at least two nozzle lines for squirting an ink of the same color, and at least one nozzle line for squirting an ink of a different color situated between said at least two nozzle lines.

9. The apparatus as claimed in claim 8, wherein said inkjet recording unit is configured such that said at least two nozzle lines for squirting an ink of the same color are arranged symmetrically with respect to an axis perpendicular to the main scan direction.

10. An apparatus for printing color inkjet images, comprising:

an input unit configured to input color image data; and an image processing unit configured to perform image processing on the color image data, said apparatus characterized in that a control unit is provided that is operable to control an order of ink squirts in which a plurality of inks of respective colors are squirted onto a given pixel by taking into account amounts of inks necessary to be used, by use of a plurality of different orders.

11. The apparatus as claimed in claim 10, wherein said control unit is configured to control the order of ink squirts separately for each page of the input color image data.

12. The apparatus as claimed in claim 11, characterized in that an inkjet recording unit is provided that is operable to squirt the plurality of inks of respective colors onto a give pixel in the plurality of different orders, said inkjet recording unit including:

a plurality of nozzle lines arranged in a main scan direction, each of the nozzle lines including a plurality of nozzles arranged in a sub-scan direction, the nozzle lines including at least two nozzle lines for squirting an ink of the same color, and at least one nozzle line for squirting an ink of a different color situated between said at least two nozzle lines.

13. The apparatus as claimed in claim 12, wherein said inkjet recording unit is configured such that said at least two nozzle lines for squirting an ink of the same color are arranged symmetrically with respect to an axis perpendicular to the main scan direction.

14. The apparatus as claimed in claim 10, wherein said control unit is configured to control the order of ink squirts separately for each pixel or block of the input color image data.

15. The apparatus as claimed in claim 14, characterized in that an inkjet recording unit is provided that is operable to squirt the plurality of inks of respective colors onto a give pixel in the plurality of different orders, said inkjet recording unit including:

a plurality of nozzle lines arranged in a main scan direction, each of the nozzle lines including a plurality of nozzles arranged in a sub-scan direction, the nozzle lines including at least two nozzle lines for squirting an ink of the same color, and at least one nozzle line for squirting an ink of a different color situated between said at least two nozzle lines.

16. The apparatus as claimed in claim 15, wherein said inkjet recording unit is configured such that said at least two nozzle lines for squirting an ink of the same color are arranged symmetrically with respect to an axis perpendicular to the main scan direction.

17. The apparatus as claimed in claim 10, characterized in that an inkjet recording unit is provided that is operable to squirt the plurality of inks of respective colors onto a give pixel in the plurality of different orders, said inkjet recording unit including:

a plurality of nozzle lines arranged in a main scan direction, each of the nozzle lines including a plurality of nozzles arranged in a sub-scan direction, the nozzle lines including at least two nozzle lines for squirting an ink of the same color, and at least one nozzle line for squirting an ink of a different color situated between said at least two nozzle lines.

18. The apparatus as claimed in claim 17, wherein said inkjet recording unit is configured such that said at least two nozzle lines for squirting an ink of the same color are arranged symmetrically with respect to an axis perpendicular to the main scan direction.

19. An image forming apparatus, comprising:

an input unit configured to input color image data; and an image processing unit configured to perform image processing on the color image data, said apparatus characterized in that a control unit is provided that is operable to control an order of ink squirts in which a plurality of inks of respective colors are squirted onto a given pixel in response to a color range required for the color image data, by use of a plurality of different orders.

20. An image forming apparatus, comprising:

an input unit configured to input color image data; and an image processing unit configured to perform image processing on the color image data, said apparatus characterized in that a control unit is provided that is operable to control an order of ink squirts in which a plurality of inks of respective colors are squirted onto a give pixel by taking into account amounts of inks necessary to be used, by use of a plurality of different orders.

* * * * *